US005203541A

United States Patent [19]

Nix

[11] Patent Number: 5,203,541

[45] Date of Patent: Apr. 20, 1993

[54] TENSIONING MECHANISM FOR STRAPPING TOOL

[75] Inventor: Robert J. Nix, Algonquin, Ill.

[73] Assignee: Signode Corporation, Glenview, Ill.

[21] Appl. No.: 689,496

[22] Filed: Apr. 23, 1991

[51] Int. Cl.[5] ..... B25B 25/00

[52] U.S. Cl. ..... 254/218; 140/123.5; 254/243

[58] Field of Search ..... 254/216–218, 254/243; 140/93 R, 93.2, 93.4, 123.5; 100/32

[56] References Cited

U.S. PATENT DOCUMENTS

| | | | |
|---|---|---|---|
| 1,995,347 | 3/1935 | Harvey | 140/93 R X |
| 2,969,221 | 1/1961 | Harmes | 254/218 |
| 3,080,148 | 3/1963 | Knoebel et al. | 254/216 X |
| 3,194,541 | 7/1965 | Kocian | 254/216 |
| 3,380,485 | 4/1968 | Plattner | 140/93.2 |
| 3,830,263 | 8/1974 | Benfer | 140/93.2 |
| 3,998,429 | 12/1976 | Cheung | 254/79 |
| 4,015,643 | 4/1977 | Cheung | 254/216 X |
| 4,041,993 | 8/1977 | Angarola | 140/123.6 |
| 4,282,907 | 8/1981 | Massion et al. | 140/123.5 X |

*Primary Examiner*—Daniel P. Stodola
*Assistant Examiner*—Michael R. Mansen
*Attorney, Agent, or Firm*—Dressler, Goldsmith, Shore, Sutker & Milnamow, Ltd.

[57] ABSTRACT

A tensioning mechanism for a strapping tool. The tensioning mechanism comprises a housing structure, a shaft mounted rotatably to the shaft, a handle coupled to the shaft, and a coupler for coupling the handle to the shaft. The handle is a tension-sensing handle comprising plural members capable of pivotal movement relative to each other and biased in such manner that tension limits can be user-adjusted within a separately adjustable range. Pivotal movement of the handle is limited in such manner that the handle cannot be further pivoted, even in small increments, after sufficient tension has been sensed by the handle.

10 Claims, 7 Drawing Sheets 392
382
380
86
162
346
360
356
358
362
344
348
284
394
396
30
206
204
202
200
220
230
226
34
390
228
306
194
192
392
382
232
176
182
308
86
186
264
262
248
240
280
380
22
132
360
178
362
136
134
86
358
318
356
304
344
162
410
412
146
164
150
154
416
156
166
168
344
346
162
130
22
132
348
136
134
158
152
148
152a
166

TENSIONING MECHANISM FOR STRAPPING TOOL

TECHNICAL FIELD OF THE INVENTION

This invention pertains to a tensioning mechanism for a strapping tool, as used to apply a steel or polymeric strap in a tensioned loop around a package, and particularly to such a mechanism having a tension-sensing handle with novel features. A first novel feature enables tension limits to be user-adjusted within a separately adjustable range. A second novel feature entails that the handle cannot be further pivoted in small increments after a tension limit has been reached. These novel features may be advantageously combined.

BACKGROUND OF THE INVENTION

Manual strapping tools have been widely used for many years to apply steel straps or polymeric straps, such as polyester or polypropylene straps, in tensioned loops around packages of diverse types. Some of these strapping tools employ metal seals, which are crimped onto overlapped layers of such steel or polymeric straps. Others punch interlockable keys into overlapped layers of steel straps. Others produce friction welds between overlapped layers of polymeric straps.

As an example, Cheung U.S. Pat. No. 3,998,429 discloses a manual strapping tool having a tension-sensing handle, which is used to actuate a tensioning mechanism via a shaft driven rotatably by the handle. The handle is articulate and comprises a drive lever, which is coupled to the shaft via a ratchet drive, and a handle lever, which is mounted pivotally to the drive lever. The handle lever is biased against the drive lever by a biasing spring, which is adjustable via an adjusting screw.

In the manual strapping tool disclosed in the Cheung patent noted above, pivotal movement of the handle in one rotational direction tensions a strap. When sufficient tension has been imparted to the strap, the biasing spring is compressed and the handle lever pivots on the drive lever, until an arm on the handle lever engages a fixed set of stop teeth. When the arm engages such teeth, the drive lever cannot be further pivoted in the rotational direction noted above, except in small increments in a manner explained in such patent.

In a tensioning mechanism for a strapping tool, two additional features would be highly desirable. Specifically, it would be highly desirable if tension limits could be user-adjusted within a separately adjustable range. Also, it would be highly desirable if the handle of the tensioning mechanism could not be further pivoted in small increments after a tension limit had been reached.

SUMMARY OF THE INVENTION

This invention provides, for a strapping tool, a tensioning mechanism embodying the additional features noted above in a preferred embodiment. Broadly, the tensioning mechanism comprises a housing structure, a shaft mounted rotatably to the housing structure, and a handle coupled to the shaft in a specified manner. The handle is coupled to the shaft so that the shaft can be rotatably driven in a tensioning direction, when the handle is pivoted about the shaft in one pivotal direction, and so that the handle can be oppositely pivoted about the shaft without rotating the shaft. The handle is a tension-sensing handle having improved features.

According to a first aspect of this invention, the handle is articulate and comprises plural handle members capable of pivotal movement relative to each other and biased in an improved manner, whereby tension limits can be user-adjusted within a separately adjustable range. According to a second aspect of this invention, pivotal movement of the handle is limited in an improved manner, whereby the handle cannot be further pivoted in small increments after the tension limit has been reached.

Broadly, the handle members include a mounting member, a gripping member, and a reaction member. The mounting member is coupled to the shaft, as described above. The gripping member is mounted to the mounting member so as to permit pivotal movement of the gripping member relative to the mounting member between a normal position and a displaced position. The reaction member is movable conjointly with the gripping member between the normal and displaced positions.

The gripping and reaction members are biased toward the normal position but can be forcibly displaced toward the displaced position. Pivotal movement of the mounting member about the shaft is controlled so as to permit pivotal movement of the mounting member about the shaft in the tensioning direction with the gripping and reaction members in the normal position and so as to prevent pivotal movement of the gripping and reaction members from the normal position into the displaced position.

According to the first aspect of this invention, the gripping and reaction members are biased by components including an adjusting screw, a follower, a spring, and a structure for limiting rotational adjustment of the adjusting screw. The adjusting screw, which has a head and a shank and which defines an axis, is mounted to the mounting member of the handle so as to permit rotational adjustment of the adjusting screw relative to the mounting member without axial movement of the adjusting screw relative to the mounting member. The follower, which preferably has an aperture with an internal thread coacting with an external thread of the adjusting screw shank, coacts with the mounting member so as to permit axial movement of the follower along the shank of the adjusting screw without rotational movement of the follower relative to the mounting member upon rotational adjustment of the adjusting screw.

The spring, which coacts with the reaction member and with the follower, biases the gripping and reaction members toward the normal position. The spring, which is compressible, is arranged to be more compressed upon rotational adjustment of the adjusting screw in a first rotational direction and so as to be less compressed upon rotational adjustment of the adjusting screw in a second rotational direction opposite to the first rotational direction. The limiting structure limits rotational adjustment of the adjusting screw in either of the first and second rotational directions to a limited range and is adjustable to adjust the limited range.

Preferably, the shank of the adjusting screw is tubular and has an internal thread (as well as the external thread noted above), and the limiting feature comprises a limiting screw having a head and a shank with an external thread coacting with the internal thread of the shank of the adjusting screw. The head of the limiting screw is arranged to engage the reaction member so as to limit rotational adjustment of the adjusting screw in the first rotational direction.

Preferably, the limiting structure comprises a washer disposed around the shank of the limiting screw, between the head of the limiting screw and the shank of the adjusting screw. It is preferred that the washer has an annular portion disposed around the shank of the limiting screw, between the head of the limiting screw and the shank of the adjusting screw, and a sleeve portion disposed around the shank of the adjusting screw. It is preferred that the internal thread extends through the head of the adjusting screw, as well as through the shank of the adjusting screw, and that the limiting structure comprises a set screw coacting with the internal thread and bearing against the shank of the limiting screw so as to stabilize the limiting screw relative to the adjusting screw.

According to the second aspect of this invention, pivotal movement of the mounting member about the shaft is controlled by components including a stop plate, a stop pawl, a biasing element, and a structure for retaining the stop pawl. The stop plate has an arcuate array of stop teeth in coaxial relation to the shaft and in fixed relation to the housing structure. The stop pawl is mounted to the mounting member so as to be rotatably movable between an operative position and an inoperative position. The stop pawl permits pivotal movement of the mounting member in the tensioning direction when the stop pawl is in the inoperative position. The stop pawl coacts with the stop plate so as to prevent pivotal movement of the mounting member in the tensioning direction when the stop pawl is in the operative position. The stop pawl has a working edge disposed to be fully disengaged from all of the stop teeth with the stop pawl in the inoperative position and to engage at least one of the stop teeth with the stop pawl in the inoperative position. The biasing element biases the stop pawl rotationally toward the operative position. The retaining structure retains the stop pawl releasably in the inoperative position with the gripping and reaction members in the normal position. The retaining structure releases the stop pawl so as to permit the stop pawl to rotate toward the operative position upon displacement of the gripping and reaction members from the normal position into the displaced position.

Preferably, the stop pawl has a pocket, and the retaining structure comprises a pin carried by the reaction member. The pin is arranged to be removably inserted into the pocket so as to retain the stop pawl in the inoperative position when the stop pawl is rotated into the inoperative position with the gripping and reaction members in the normal position. The pin is removable from the pocket so as to release the stop pawl when the gripping and reaction members are displaced from the normal position into the displaced position.

It is preferred that the mounting member is pivotable between an extreme position in the tensioning direction and an extreme position in the opposite direction, except when pivotal movement of the mounting member in the tensioning direction is prevented by the stop pawl, and that the tensioning mechanism comprises a structure for rotating the stop pawl from the operative position into the inoperative position upon pivotal movement of the mounting member to a position corresponding to the extreme position in the direction opposite to the tensioning direction. The rotating structure coacts with the stop pawl so as to retard pivotal movement of the mounting member toward the corresponding position when the mounting member reaches a retarding position before the corresponding position but permits the mounting member to be forcibly pivoted beyond the retarding position to the corresponding position.

The tensioning mechanism, in a preferred embodiment embodying the first and second aspects of this invention, offers significant advantages over mechanisms known heretofore for similar uses. Tension limits, which are sensed by the handle of the tensioning mechanism, can be user-adjusted within a separately adjustable range. The separately adjustable range can be preadjusted to adapt the tensioning mechanism for tensioning a particular type, grade, width, or gauge of steel strap having a higher tensile strength or polymeric strap having a lower tensile strength. Pivotal movement of the handle is limited in such manner that the handle cannot be further limited in small increments after the tension limit has been reached.

These and other objects, features, and advantages of this invention are evident from the following description of a preferred embodiment of this invention with reference to the accompanying drawings.

DETAILED DESCRIPTION OF PREFERRED EMBODIMENT

Figure 1:
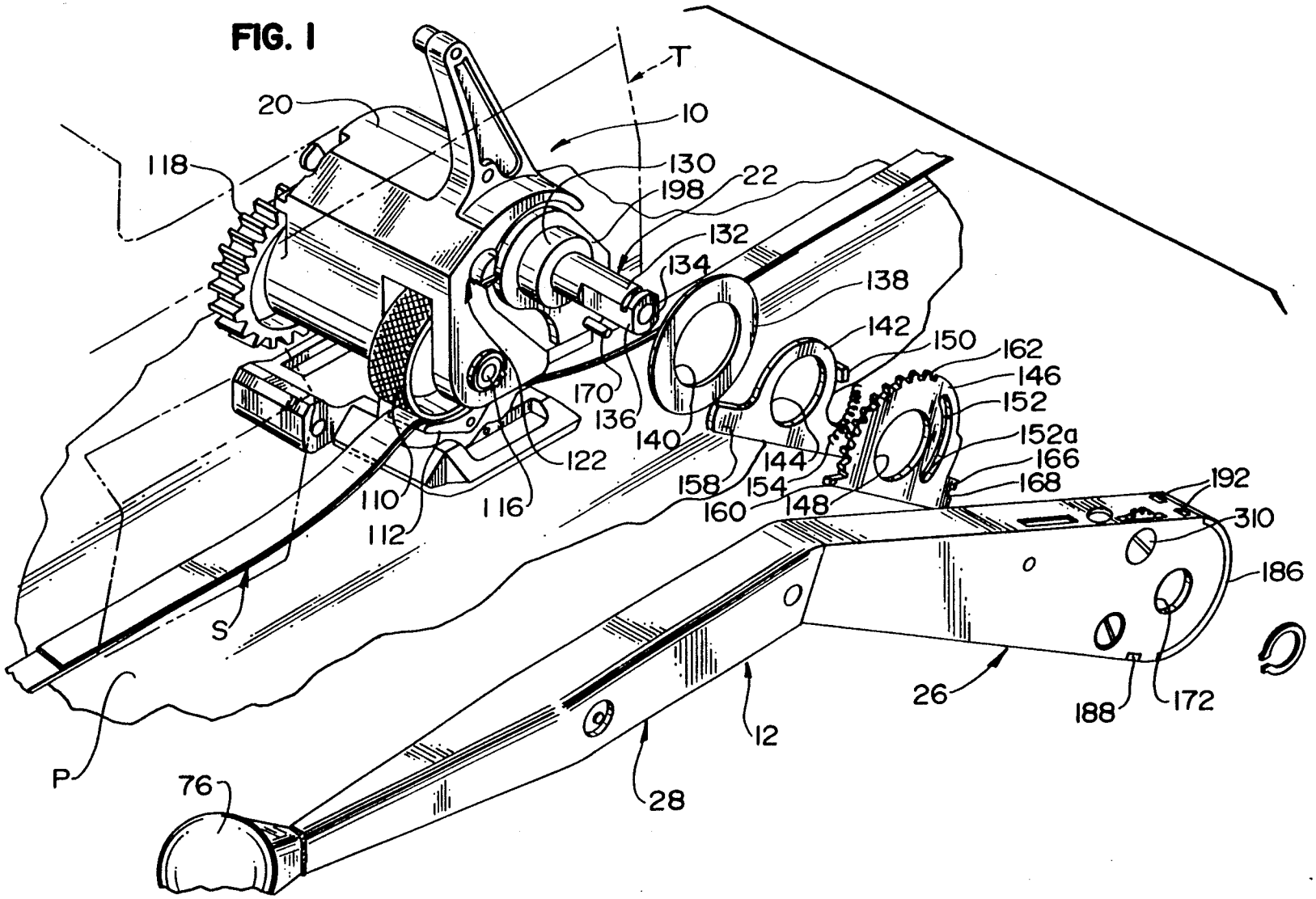
FIG. 1 is an exploded, fragmentary, perspective view of a tensioning mechanism of a strapping tool, along with a strap being applied in a tensioned loop around a package. Other components of the strapping tool and the package are shown fragmentarily in broken lines.

As shown in FIG. 1, a tensioning mechanism 10 for a strapping tool constitutes a preferred embodiment of this invention. Other elements of the strapping tool T are shown fragmentarily, in broken lines, in FIG. 1. The tensioning mechanism 10 comprises a tension-sensing handle 12, which is arranged to be manually pivoted so as to actuate the tensioning mechanism 10. Among its improved features, the handle 12 comprises plural members capable of pivotal movement relative to each other and biased in an improved manner, whereby tension limits can be user-adjusted within a separately adjustable range. Additionally, pivotal movement of the handle 12 is limited in an improved manner, whereby the handle 12 cannot be further pivoted in small increments after a tension limit has been sensed by the handle 12. These and other improved features of the handle 12 are described below.

Moreover, the tensioning mechanism 10 comprises a housing structure 20, a shaft 22 mounted rotatably to the housing structure 20 and extended axially from the housing structure 20, and a device 24 (FIG. 3) for coupling the handle 12 to the shaft 22. The shaft 22 defines an axis. The coupling device 24 causes the shaft 22 to be rotatably driven in a tensioning direction when the handle 12 is pivoted about the axis defined by the shaft 22 in one pivotal direction, which is counterclockwise in FIGS. 1, 2, etc. The coupling device 24 enables the handle 12 to be oppositely pivoted about the axis defined by the shaft 22 without rotating the shaft 22. Apart from the tensioning mechanism 10, the strapping tool T may be otherwise similar to strapping tools known heretofore for applying a steel or polymeric strap of a known type, such as the strap S shown fragmentarily in FIG. 1, in a tensioned loop around a package, such as the package P shown fragmentarily in FIG. 1. The tensioning mechanism 10 is useful whether the strapping tool T is arranged to crimp a metal seal (not shown) over two overlapped layers of a steel or polymeric strap, to punch interlockable keys into two overlapped layers of a steel strap, or to produce a friction or other weld between two overlapped layers of a polymeric strap.

Figure 2:
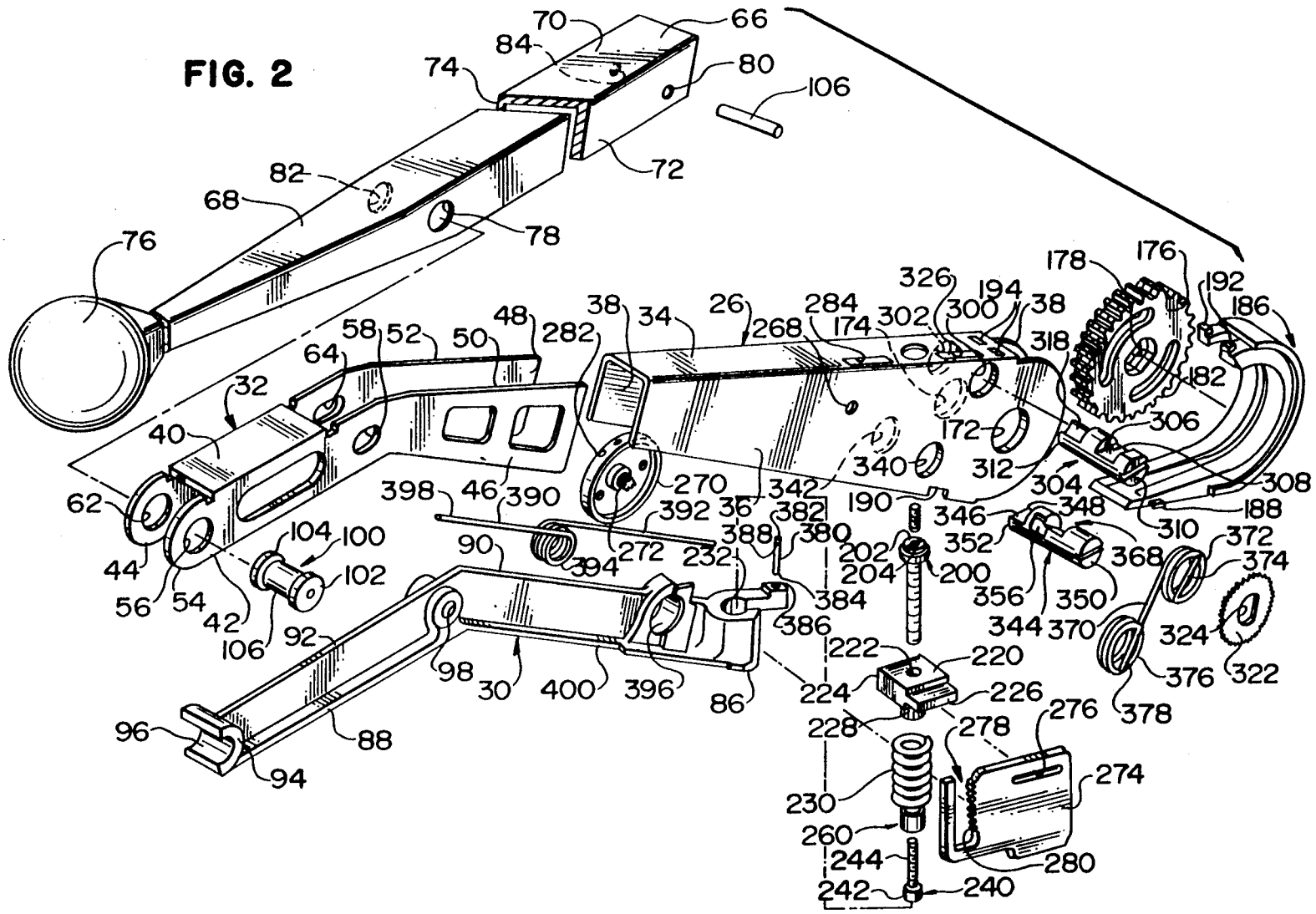
FIG. 2 is an exploded, fragmentary, perspective view of a handle and associated components, as included in the tensioning mechanism.
Figures 3, 4:
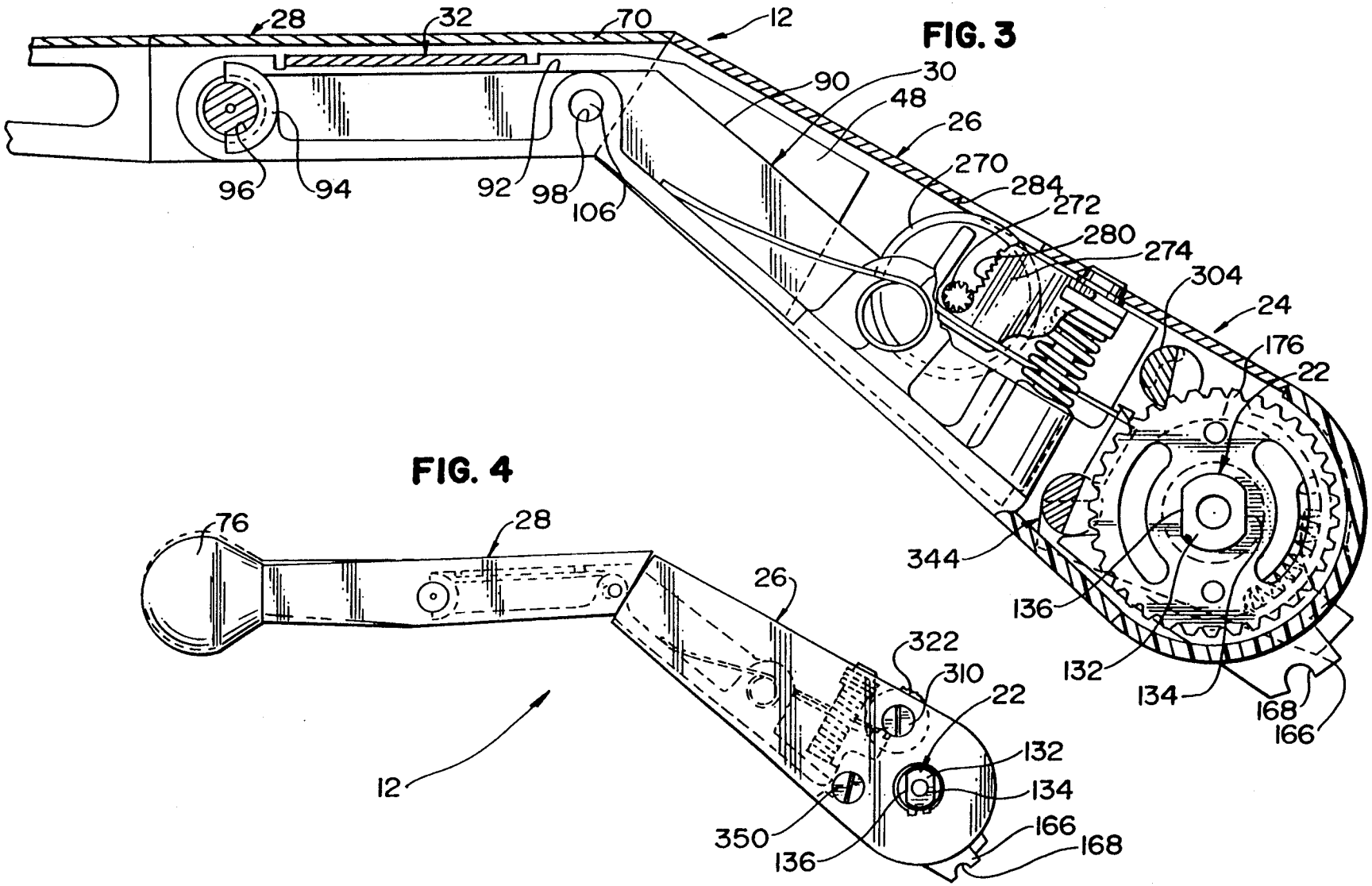
FIG. 3, on an enlarged scale compared to FIGS. 1 and 2, is a fragmentary, sectional view taken through the handle, as assembled.
FIG. 4, on a reduced scale compared to FIGS. 1 and 2, is an elevational view of the handles, as assembled, with certain concealed elements being shown in broken lines.

As shown in FIGS. 2 and 3, the handle 12 is articulate and comprises a mounting member 26, a gripping member 28, a reaction member 30, and a bracket member 32. The mounting member 26 is coupled to the shaft 22 by the coupling device 24.

The mounting member 26 is fabricated from sheet steel so as to define a top wall 34 and similar side walls 36, 38, which are tapered, as shown. The bracket member 32 is fabricated from sheet steel so as to have a top wall 40, and similar side walls 42, 44. The side wall 42 has an elongate extension 46, which is tapered, as shown, so as to confirm generally to the side wall 36 of the mounting member 26. The side wall 44 has an elongate extension 48, which is tapered similarly so as to conform generally to the side wall 38 of the mounting member 26. The side wall 42, at the elongate extension 46, has an upper edge 50 oriented at an obtuse angle relative to the top wall 40. The side wall 44 at the elongate extension 48 has an upper edge 52 oriented at a similar angle relative to the top wall 40. The bracket member 32 and the mounting member 26 are assembled with the respective extensions 46, 48, disposed between and welded to the mounting member 26 side walls 36, 38, and with the upper edges 50, 52, disposed near the top wall 40. Thus, the bracket member 32 is welded to the mounting member 26 at the respective extensions 46, 48. The bracket member side wall 42, near one end 54 opposite to the elongate extension 46, has a pivot pin-receiving aperture 56, which is circular. Between the pivot pin-receiving aperture 56 and the elongate extension 46, the bracket member side wall 42 has a roll pin-receiving slot 58, which is elongate. The bracket member side wall 44, near one end 60 opposite to the elongate extension 48, has a pivot pin-receiving aperture 62 similar to and aligned with the pivot pin-receiving aperture 56. Between the pivot pin-receiving aperture 62 and the elongate extension 48, the bracket member side wall 44 has a roll pin-receiving slot 64, which is similar to and aligned with the roll pin-receiving slot 58.

The gripping member 28 has a proximal portion 66 and a distal portion 68 and is fabricated from sheet metal so as to define a top wall 70 and similar side walls 72, 74, which are bent slightly where the proximal portion 66 adjoins the distal portion 68. A knob 76 is secured to the distal portion 68. When the handle 12 is assembled, the bracket member side walls 42, 44, are disposed between the gripping member side walls 72, 74, at the proximal portion 66. Also, the bracket member top wall 40 is disposed beneath the gripping member top wall 70, in spaced relation to the gripping member top wall 70. The side wall 72, at the proximal portion 66 of the gripping member 28, has a pivot pin-receiving aperture 78 similar to the pivot pin-receiving aperture 56 of the bracket member side wall 42 and a roll pin-receiving aperture 80 spaced from such aperture 78. The aperture 80 is circular. The side wall 74, at the proximal portion 66 of the gripping member 28, has a pivot pin-receiving aperture 82 similar to the pivot pin-receiving aperture 62 of the bracket member side wall 44 and a roll pin-receiving aperture 84 similar to the aperture 80 and spaced from such aperture 82. When the handle 12 is assembled, the pivot pin-receiving apertures 78, 82, are aligned with each other and with the pivot pin-receiving apertures 56, 62. Also, the roll pin-receiving apertures 80, 84, are aligned with each other and with the roll pin-receiving slots 58, 64, of the bracket member side walls 42, 44.

The reaction member 30, which is fabricated from steel stock, has a proximal portion 86 and a distal portion 88. An upper edge 90 of the proximal portion 86 and an upper edge 92 of the distal portion 88 define an obtuse angle where such edges 90, 92, adjoin each other. The distal portion 88 has an end formation 94 with a semi-cylindrical surface 96. In spaced relation to such formation 94, the distal portion 88 has a circular, pivot pin-receiving aperture 98. When the handle 12 is assembled, the distal portion 88 is disposed between the bracket member side walls 42, 44. Also, the semi-cylindrical surface 96 of the end formation 94 is aligned with the pivot pin-receiving apertures 56, 62, of the bracket member side walls 42, 44, and with the pivot pin-receiving apertures 78, 82, of the gripping member side walls 72, 74.

A pivot pin 100, which as spool-shaped, has two end portions 102, 104, each having a larger diameter, and a middle portion 106 having a smaller diameter and conforming to the semi-cylindrical surface 96. The larger diameter enables the end portion 102 to be axially fitted into the pivot pin-receiving apertures 56, 62, and the end portion 104 to be axially fitted into the pivot pin-receiving apertures 78, 82. Each of the end portions 102, 104, has an axial length sufficient to enable the end portion 102 to extend axially in an outward direction, through the pivot pin-receiving aperture 56, into the pivot pin-receiving aperture 78, and to enable the end portion 104 to extend axially in an opposite direction, through the pivot pin-receiving aperture 62, into the pivot pin-receiving aperture 82. When the handle 12 is assembled, the pivot pin 102 is inserted such that the end portions 102, 104, extend axially therethrough, and end formation 94 of the distal portion 88 of the reaction member 30 fits between the end portions 102, 104. Also, the middle portion 106, fits rotatably against the semi-cylindrical surface 96 of such formation 94. Furthermore, a roll pin 106 is inserted so as to extend exteriorly through the roll pin-receiving apertures 80, 84, of the gripping member side walls 72, 74, intermediately through the roll pin-receiving slots 58, 64, of the bracket member side walls 42, 44, and interiorly through the roll pin-receiving aperture 98 of the distal portion 88 of the reaction member 30.

The roll pin-receiving slots 58, 64, provide sufficient clearance for the roll pin 106 to permit pivotal movement of the gripping member 28 and the reaction member 30 relative to the bracket member 32 and the mounting member 30, as welded to the bracket member 32, over a limited range of pivotal movement. Thus, the gripping member 28 is mounted to the mounting member 26, via the bracket member 32 and the pivot pin 100, so as to permit pivotal movement of the gripping member 28 relative to the mounting member 26 between a normal position and a displaced position. In FIG. 4, the gripping member 28 is shown in the normal position in broken lines, and in the displaced position in full lines. Also, the reaction member 30 is movable conjointly with the gripping member 28, between the normal and displaced positions.

As shown in FIG. 1, a knurled wheel 110, which is journalled to the housing structure 20, is arranged to coact with an anvil 112, which is mounted pivotally to the housing structure 20, so as to draw an outer layer of two overlapped layers of a strap, such as the strap S, along an inner layer of the overlapped layers in such manner that the strap is drawn into a tensioned loop around a package, such as the package P, when the knurled wheel 110 is rotated in a tensioning direction, which is clockwise in FIG. 2. These are known components used commonly in tensioning mechanisms for strapping tools.

The shaft 22 is coupled to the shaft 116 for conjoint rotation, via gears 118 (one shown) and via a ratchet mechanism (not shown) which is actuated by a release pawl 122 journalled to and extended from the housing structure 20. The release pawl 122 has a chordal surface 124 for a purpose to be later mentioned. The ratchet mechanism is arranged, in a known manner, such that rotation of the release pawl 122 in one rotational direction, which is clockwise in FIG. 1, permits free rotation of the shaft 116 relative to the housing structure 20. The release pawl 122, which is biased in the opposite direction, prevents reverse rotation of the shaft 116 (and consequent loss of strap tension) unless the release pawl 122 is rotated so as to permit free rotation of the shaft 116 relative to the housing structure 20.

The shaft 22 is journalled in a bearing tube 130, from which the shaft 22 extends, as shown in FIG. 1. The bearing tube 130 is journalled to two spaced, upright flanges 198 (one shown) of a base for the tensioning mechanism 10. The bearing tube 130 allows pivotal movement of the housing structure 20 relative to the flanges 198 and allows rotational movement of the shaft 22 relative to the housing structure 20. A distal portion 132 of the shaft 22 has two diametrically opposed, axially extending flats 134, 136, which provide the distal portion 132 with a non-circular cross-section. An annular spacer 138, which has a central aperture 140, is disposed around the bearing tube 130, next to the housing structure 20. An actuator plate 142, which has a circular aperture 144, is disposed around the bearing tube 130, next to the annular spacer 138. A stop plate 146, which has a circular aperture 148, is disposed around the bearing tube 130, next to the actuator plate 142. The actuator plate 142 has a tab 150 extending axially into an arcuate slot 152 in the stop plate 146 so as to limit relative rotation of the actuator plate 142 and the stop plate 146 about the bearing tube 130. A coiled spring 154, which is dimensioned so as to fit within the slot 152, is deployed within the slot 152, between one end **152*a* of the slot 152 and the tab 150 so as to bias the actuator plate 142 relative to the stop plate 146 in one rotational direction, which is counterclockwise in FIG. 1. The actuator plate 142 has an input arm 156, which functions in a manner to be later described, and an actuating arm 158, which is arranged to engage the chordal surface 124 of the release pawl 122 so as to rotate the release pawl 122 sufficiently to permit free rotation of the shaft 116 relative to the housing structure 20, as mentioned above, upon rotation of the actuator plate 142 in one rotational direction, which is clockwise in FIG. 1, for a sufficient distance. The stop plate 136 has a limiting arm 160, an arcuate array of stop teeth 162 adjacent to the limiting arm 160, a camming portion 164 adjacent to the stop teeth 162, and a positioning arm 166. The positioning arm 166 has a notch 168, which receives a pin 170 extending from a nearer one of the base flanges 198 so as to prevent rotation of the stop plate 136 about the shaft 22**.

The distal portion 132 of the shaft 22 extends through circular apertures 172, 174, which are aligned with each other in the mounting member side walls 36, 38, such that the mounting member 26 is pivotable about the axis defined by the shaft 22. A pair of similar ratchet wheels 176, which have non-circular apertures 178 shaped so as to accommodate the distal portion 132, are mounted on the distal portion 132 so as to be conjointly rotatable with the shaft 22. Each of the ratchet wheels 174 has ratchet teeth 182 around its circumference and the ratchet wheel 176 has ratchet teeth 184 around its circumference. A cover 186, which is molded from an engineering plastic, is mounted to the mounting member 26 via a lower tab 188 snapping into a lower notch 190 in the side wall 36, a similar tab (not shown) snapping into a similar notch (not shown) in the side wall 38, and two upper tabs 192 snapping into two upper slots 194 in the top wall 34, so as to cover the ratchet wheels 176.

An adjusting screw 200 defining an axis is mounted to the mounting member 26 of the handle 12 so as to permit rotational adjustment of the adjusting screw 200 relative to the mounting member 26 without axial movement of the adjusting screw 200 relative to the mounting member 26. The adjusting screw 200 has a tubular head 202 extending through a circular aperture in the top wall 34 of the mounting member 26. The adjusting screw head 202 has a slot 204, which is adapted to coact with a conventional tool (not shown) such as a manual screwdriver. The adjusting screw 200 has an integral, washer-like, annular flange 206, which adjoins the adjusting screw head 202 and which is adapted to bear against an inner margin 208 of the aperture 204, and a tubular shank 210, which has an external thread and an internal thread. The internal thread extends through the adjusting screw head 202 as well as through the adjusting screw shank 210.

A follower 220 has an aperture 222 (FIG. 2) with an internal thread coacting with the external thread of the adjusting screw shank 210 and has a flat surface 224 coacting with the side wall 38 of the mounting member 26 so as to permit axial movement of the follower 220 along the adjusting screw shank 210, without rotational movement of the follower 220 relative to the mounting member 26, upon rotational adjustment of the adjustment screw 200. The follower 220 has a wide tongue 226 and a tubular hub 228.

A coiled spring 230 is seated in a socket 232 in the proximal portion 86 of the reaction member 30. The spring 230 is coiled around the adjusting screw shank 210, and around the tubular hub 228, so as to bear against the follower 220. Thus, the spring 230 biases the annular flange 206 of the adjusting screw 330 against the inner margin 208 of the aperture 204, via the follower 220 and the adjusting screw shank 210. Also, the spring 230 biases the gripping member 28 and the reaction member 30 relative to the mounting member 26 and the bracket member 32 toward the normal position of these members but permits these members to be forcibly pivoted to the displaced positions of these members. Rotational adjustment of the adjusting screw 200 relative to the mounting member 26 is permitted within a limited range, which can be separately adjusted in a manner to be next described, such that rotational adjustment thereof in a first rotational direction tending to drive the follower 220 away from the adjusting screw head 202 causes the coiled spring 230 to be more compressed and such that rotational adjustment thereof in a second rotational direction tending to drive the follower 220 toward the adjusting screw head 202 causes the coiled spring 230 to be less compressed. The second rotational direction is opposite to the first rotational direction.

A limiting screw 240 is provided, which has a head 242 and a shank 244 with an external thread coacting with the internal thread of the adjusting screw shank 210. The limiting screw head 240 has a socket (not shown) adapted to coact with a conventional allen wrench (not shown) and accessible through an aperture 248 in the proximal portion 86 of the reaction member 30. A set screw 250, which is headless, has an external thread coacting with the internal thread of the adjusting screw shank 210 and bears against the limiting screw shank 244 so as to stabilize the limiting screw 240 relative to the adjusting screw 200. At one end 252, which is the end nearer to the adjusting screw head 202, the set screw 250 has a socket (not shown) adapted to coact with a conventional allen wrench (not shown) and accessible through the adjusting screw head 202. A washer 260 has an annular portion 262 disposed around the limiting screw shank 244, between the limiting screw head 242 and the adjusting screw shank 210, and a sleeve portion 264 disposed around the adjusting screw shank 210, within the coiled spring 230. The limiting screw 240 and the set screw 250 are adjustable so as to adjust the limited range of rotational adjustment of the adjusting screw 200 relative to the mounting member 26 in either of the first and second rotational directions.

The side wall 36 of the mounting member 26 has a cylindrical aperture 268. An indicating dial 270 is journalled between the side walls 36, 38, of the mounting member 26 such that a pinion gear 272, which is integral with the indicating dial 270, rotates in the circular aperture 268 of the side wall 36. A rack plate 274 has an elongate slot 276 receiving the integral tongue 226 of the follower 220. The rack plate 274 has an elongate recess 278 parallel to the adjusting screw shank 210 and provided with a toothed edge 280 coacting with the pinion gear 272 so as to cause the pinion gear 272 to rotate in a rotational direction corresponding to axial movement of the follower 220 along the adjusting screw shank 210. The indicating dial 270 is marked with visible indicia 282 (FIG. 2) around its circumference and is partly visible through an elongate slot 284 in the top wall 34 of the mounting member 26. These indicia 282 correspond respectively to different positions of rotational adjustment of the adjusting screw 330 relative to the mounting member 26.

The mounting member side walls 36, 38, have circular apertures 300, 302, which are aligned with each other. A ratchet pawl 304, which is generally cylindrical, is disposed rotatably in the apertures 300, 302, in which the ratchet pawl 304 is rotatable between an operative position and an inoperative position. The ratchet pawl 304 is biased in one rotational direction, which is counterclockwise in the drawings, toward its operative position. The ratchet pawl 304 has a flat, chordal surface 306, which defines a working edge 308. In the operative position of the ratchet pawl 304, the working edge 308 engages the ratchet teeth 182 of the ratchet wheels 174, so as to drive the ratchet wheels 174, in the tensioning direction, which is counterclockwise in the drawings, upon pivotal movement of the handle 12 about the axis defined by the shaft 22 in the tensioning direction. Moreover, the flat, chordal surface 306 acts as a camming surface enabling the working edge 308 to skip from tooth to tooth about the ratchet teeth 182, upon pivotal movement of the handle 12 about the shaft 22 in the opposite direction with the ratchet pawl 304 returning to the operative position as the working edge 308 skips from tooth to tooth. In the inoperative position of the ratchet pawl 304, the working edge 308 clears the ratchet teeth 182.

Figures 11, 12, 13:
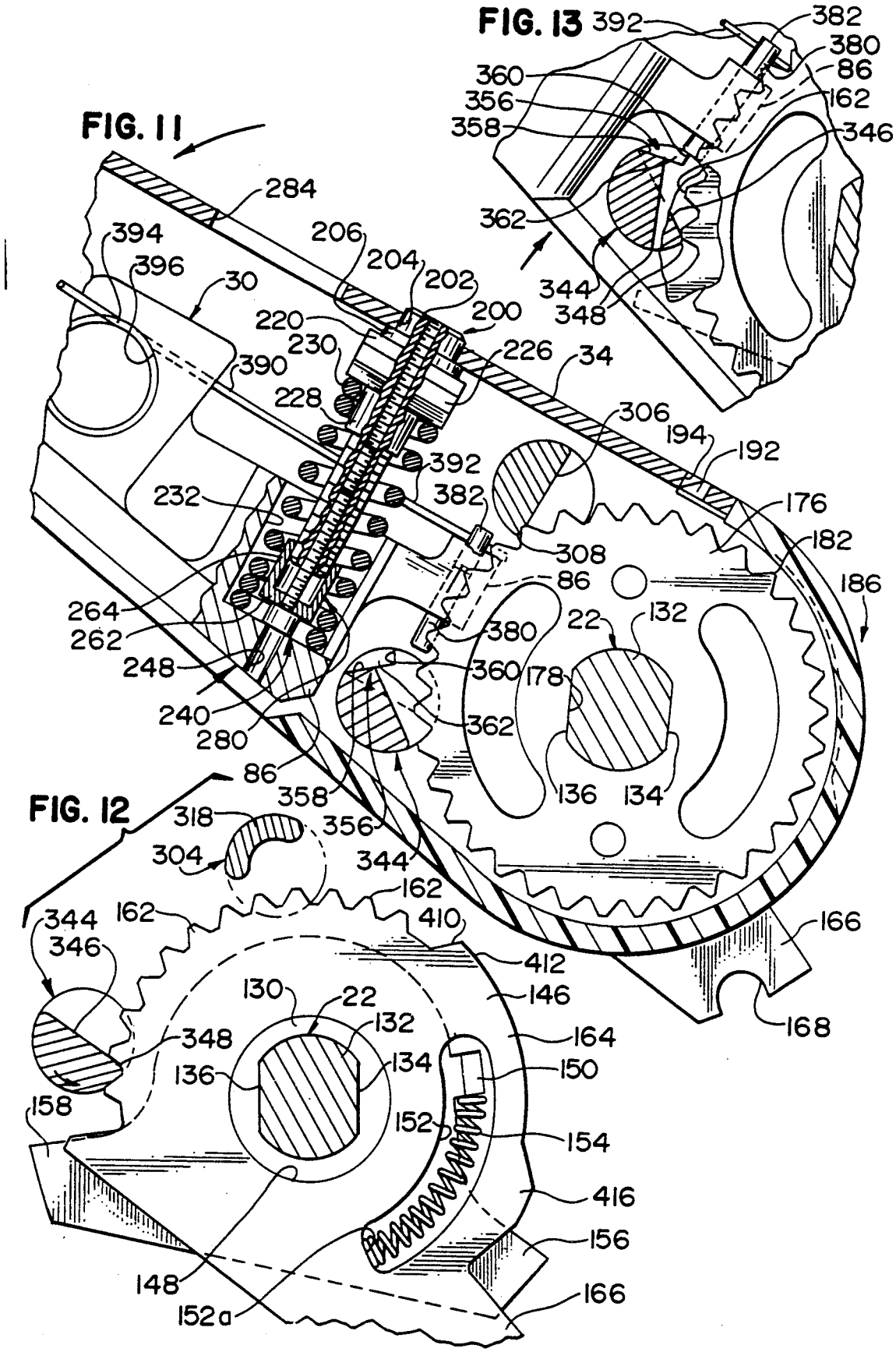
FIG. 11 is a view similar to FIG. 9 but taken to show the biasing device and certain associated components in changed positions compared to their positions in FIG. 9.
FIG. 12 is a fragmentary, elevational detail showing the pawls and certain associated components in changed positions compared to their positions in FIGS. 9 and 11 respectively. The pawls are shown in cross-section along respective planes normal to their axes.
FIG. 13 is a fragmentary, elevational detail showing the stop pawl and certain associated components in changed positions, as compared to their positions in FIGS. 9, 11, and 12 respectively. The stop pawl is shown in cross-section, in two different positions, along a plane normal to its axis.
Figure 15:
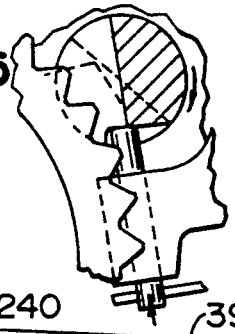
FIG. 15 is a fragmentary, elevational view showing the stop pawl and certain associated components in changed positions, as compared to their positions in FIGS. 9 and 11 through 14 respectively. The stop pawl is shown in cross-section along a plane normal to its axis.
Figure 14:
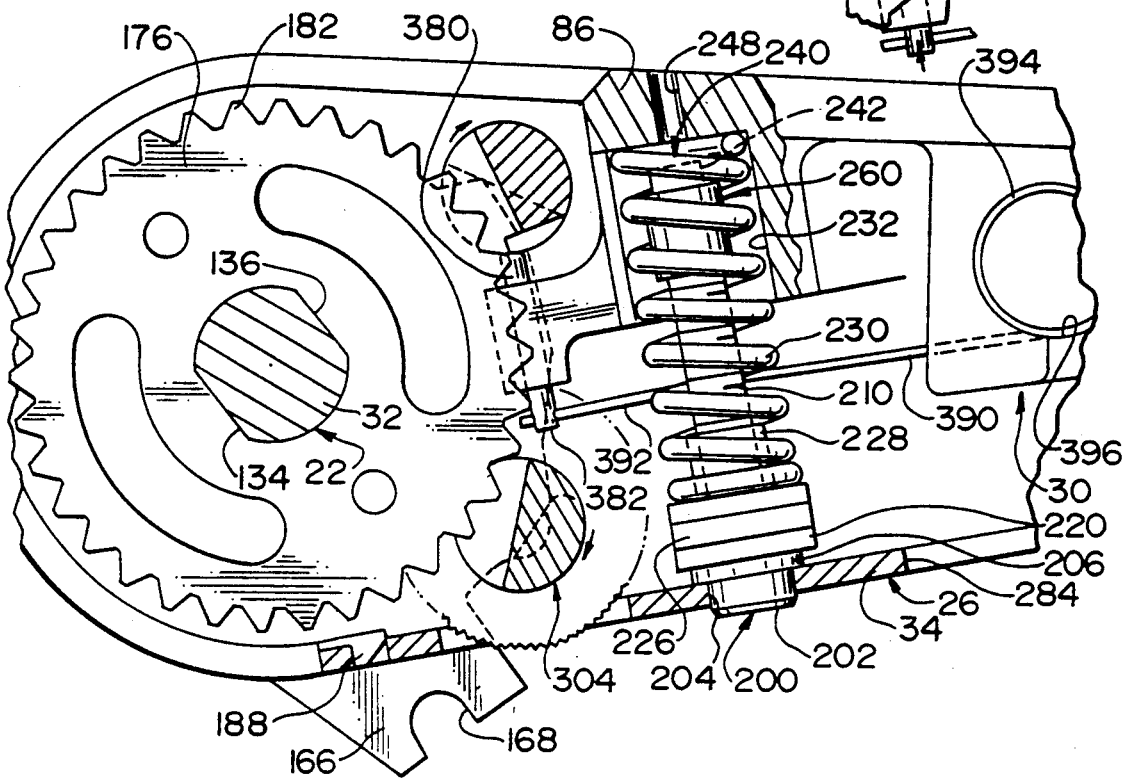
FIG. 14 is a view similar to FIGS. 9 and 11 respectively but taken to show the biasing device and certain associated components in changed positions, as compared to their positions in FIGS. 9 and 11 respectively.

The ratchet pawl 304 has a biasing end 310 and an opposite end 312. The biasing end 310 has a diagonal groove 314. The ratchet pawl 304 has a flat, chordal surface 316, which extends axially to the biasing end 310. The ratchet pawl 304 has an arcuate flange 318 having rounded ends 320 and extending axially to the opposite end 312. As shown in FIG. 12, the arcuate flange 318 clears the teeth 162 of the stop plate 146 as the ratchet pawl 304 coacts with the teeth 182, of the ratchet wheels 176. A thumb wheel 322, which has a non-circular aperture 324 conforming to the biasing end 310 and which has a serrated periphery, is fitted over the biasing end 310 so as to be conjointly rotatable with the ratchet pawl 304. The thumb wheel 322 extends partly through an elongate slot 326 in the top wall 34 of the mounting member 26. The thumb wheel 322 enables the ratchet pawl 304 to be manually rotated from the operative position into the inoperative position.

The mounting member side walls 36, 38, have circular apertures 340, 342, which are aligned with each other. A stop pawl 344, which is generally cylindrical, is disposed rotatably in the apertures 340, 342, in which the stop pawl 344 is rotatable between an operative position and an inoperative position. The stop pawl 344 is biased in one rotational direction, which is counterclockwise in the drawings, toward its operative position. The stop pawl 344 has a flat, chordal surface 346, which defines a working edge 348. In the operative position of the stop pawl 344, the working edge 348 engages the teeth 162 of the stop plate 146, as well as the teeth 182 of the ratchet wheels 176, so as to prevent pivotal movement of the mounting member 26 about the shaft 22 in the tensioning direction, which is counterclockwise in the drawings. In the inoperative position of the stop pawl 344, the working edge 348 clears the teeth 162 of the stop plate 146, as well as the teeth 182 of the ratchet wheels 174. Moreover, in the operative position the flat, chordal surface 346 acts as a camming surface enabling the working edge 348 to skip from tooth to tooth about the teeth 162 of the stop plate 146, and about the teeth 182 of the ratchet wheels 174, upon pivotal movement of the mounting member 26 about the shaft 22 in the opposite direction. The stop pawl 344 is adapted to engage the limiting arm 160 of the stop plate 136 so as to limit pivotal movement of the mounting member 26 in the tensioning direction.

Figure 5:
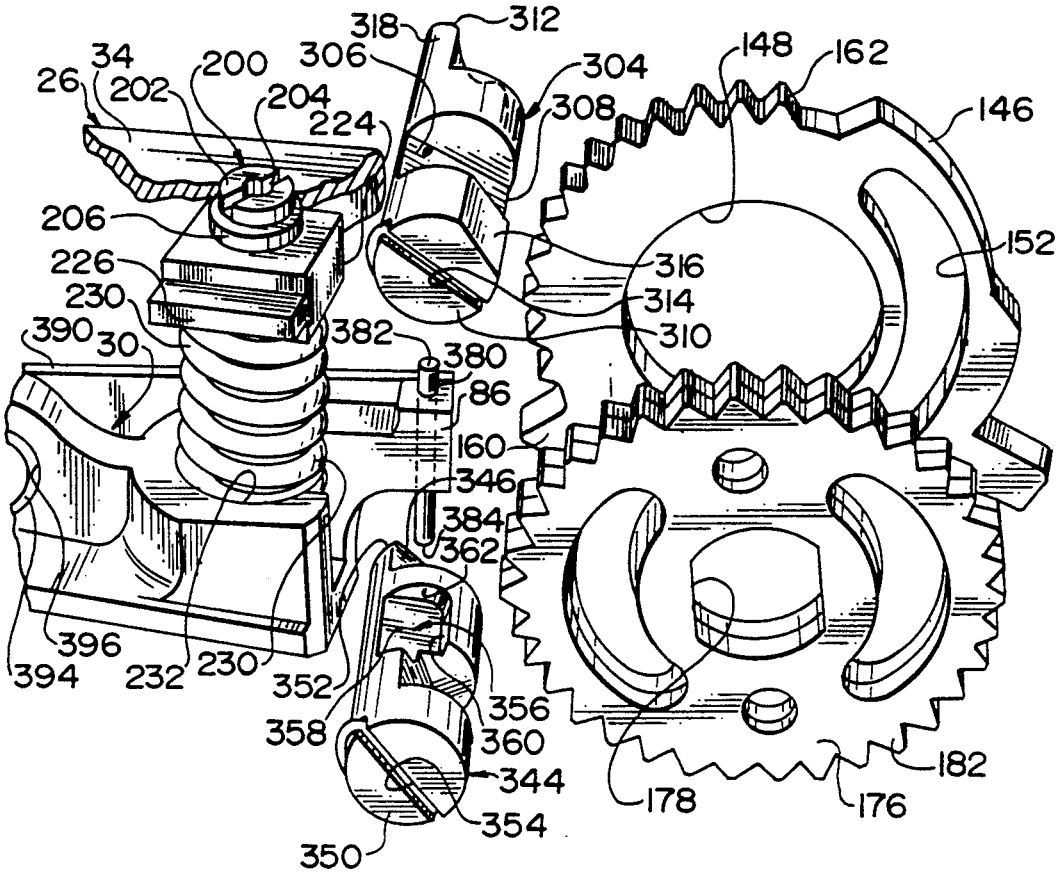
FIG. 5, on a greatly enlarged scale compared to prior views, is an exploded, fragmentary, perspective view of a biasing device and associated components, as included in or associated with the handle.
Figure 8:
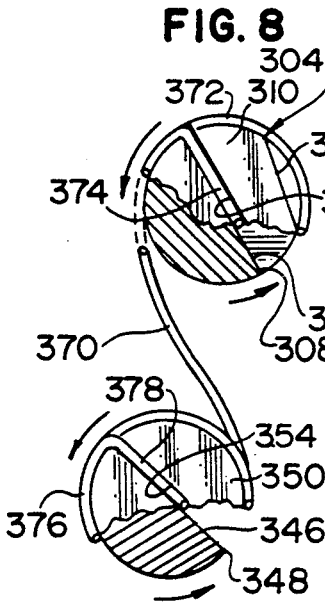
FIG. 8 is an enlarged, elevational detail of a drive pawl, a stop pawl, and an associated spring, as shown fragmentarily in FIG. 5. Portions of the pawls are shown in cross-section along respective planes normal to their axes.
Figure 6:
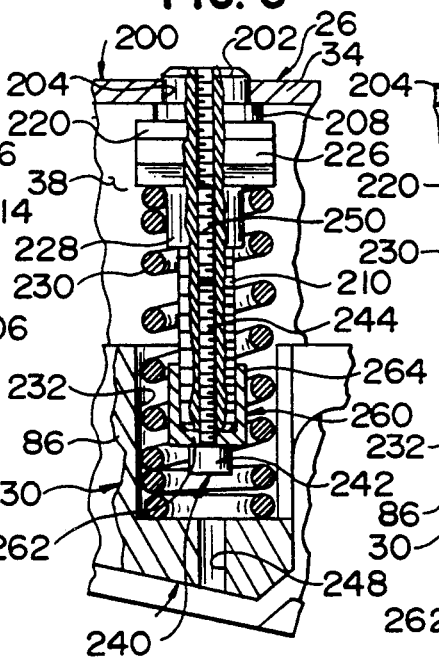
FIG. 6 is a sectional view taken through the biasing device, which is shown as adjusted to one set of possible adjustments.
Figure 7:
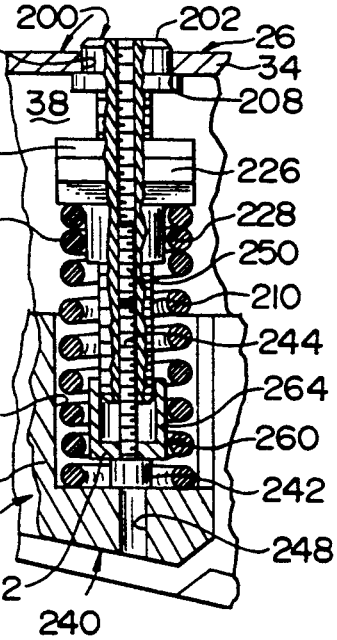
FIG. 7 is a sectional view similar to FIG. 6 but taken to show the biasing device as adjusted differently.
Figure 9:
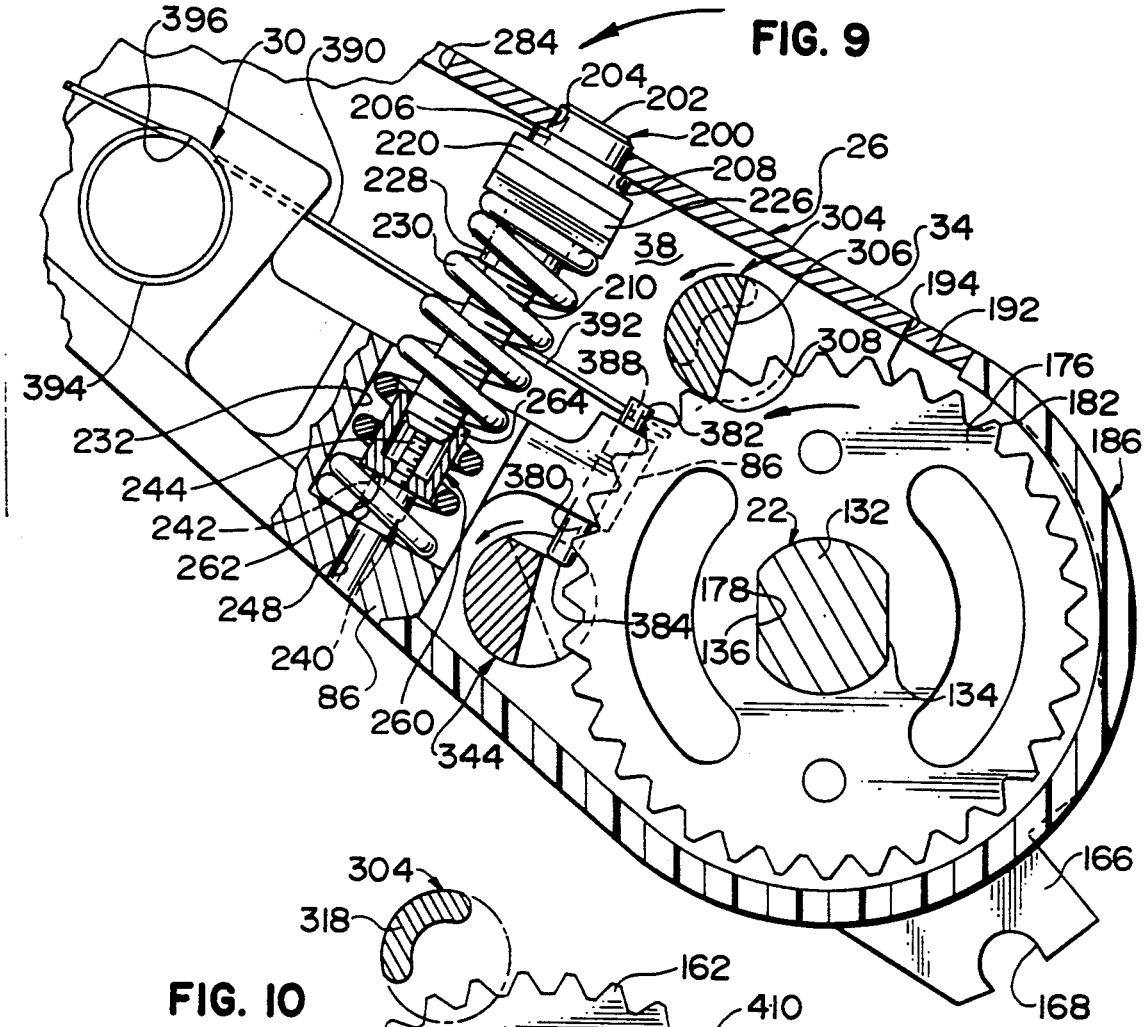
FIG. 9 is an elevational view of the biasing device, the associated components shown in FIG. 5, and other associated components, as included in or associated with the handle.

The stop pawl 344 has a biasing end 350 and an opposite end 352. The biasing end 350 has a diagonal groove 354. The stop pawl 344 has a pocket 356, Which is bounded by a chordal floor 358, a chordal wall 360 normal to the chordal floor 358, and two side walls 362 (one shown) normal to the chordal floor 358 and to the chordal wall 360, as shown in FIG. 5 and elsewhere. The flat, chordal surface 346 extends to the opposite end 352. The stop pawl 344 has an additional pocket 368 (FIG. 2) providing clearance for adjacent elements.

A torsional spring 370, which is made from one piece of spring wire, is used to bias the ratchet pawl 304 toward its operative position and to bias the stop pawl 344 toward its operative position. The torsional spring 370 has a coiled portion 372, which is coiled around the ratchet pawl 304, near its biasing end 310. The torsional spring 370 has an arm 374, which extends from the coiled portion 372 and which is deployed within the diagonal groove 314. The torsional spring 370 has a coiled portion 376, which is coiled around the stop pawl 344, near its biasing end 350, and an arm 378, which is deployed within the diagonal groove 354. Each of the coiled portions 372, 376, is pretensioned when the torsional spring 370 is installed.

A pin 380, which has a biasing end 382 and a working end 384, is carried by the proximal portion 86 of the reaction member 30 so as to be axially movable in an aperture 386 of such portion 86 between an operative position and an inoperative position. The pin 380 has an aperture 388, which extends through the pin 380, near the biasing end 382. The pin 380 is biased toward its operative position by a torsional spring 390 having an arm 392 extending through the aperture 388 near the biasing end 382 of the pin 380, a coiled portion 394 deployed within a circular aperture 396 of the reaction member 30, and an arm 398 bearing against a flange 400 of the reaction member 30. In the operative position of the pin 380, the working end 384 extends into the pocket 356 and bears against the pocket wall 360 so as to prevent the stop pawl 344 from rotating from its inoperative position into its operative position. In the inoperative position of the pin 380, the working end 384 is removed from the pocket 356 so as to permit the stop pawl 344 to rotate from its inoperative position into its operative position.

The camming portion 166 of the stop plate 146 has a leading edge 410, an arcuate edge 412, and a raised section 414, which adjoins the positioning arm 166,. Upon pivotal movement of the mounting member 26 in a rotational direction opposite to the tensioning direction for a sufficient distance to cause the flat, chordal surface 346 of the stop pawl 344 to engage the camming portion 166, after the pin 380 has been removed from the pocket 356 and the stop pawl 344 has been rotated to its inoperative position, the leading edge 410 and the arcuate edge 412 coact with such surface 346 to cam the stop pawl 344 until the stop pawl 344 is rotated sufficiently for the pin, 380 as biased by the torsional spring 370, to reenter the pocket 356. The arcuate flange 316 of the ratchet pawl 304 is cammed by the raised section 414 so as to prevent the ratchet pawl 304 from rotating from its inoperative position into its operative position. Additionally, the arcuate flange 318 engages the input arm 156 of the actuator plate 142 and rotates the actuator plate 142, against the coiled spring 154 bearing on the tab 150 of the actuator plate 142, sufficiently for the output arm 158 of the actuator plate 142 to engage the chordal surface 124 of the release pawl 122. Thus, as engaged by such arm 158, the release pawl 122 is rotated sufficiently to pivot the ratchet pawl 120 from its operative position into its inoperative position.

Figure 10:
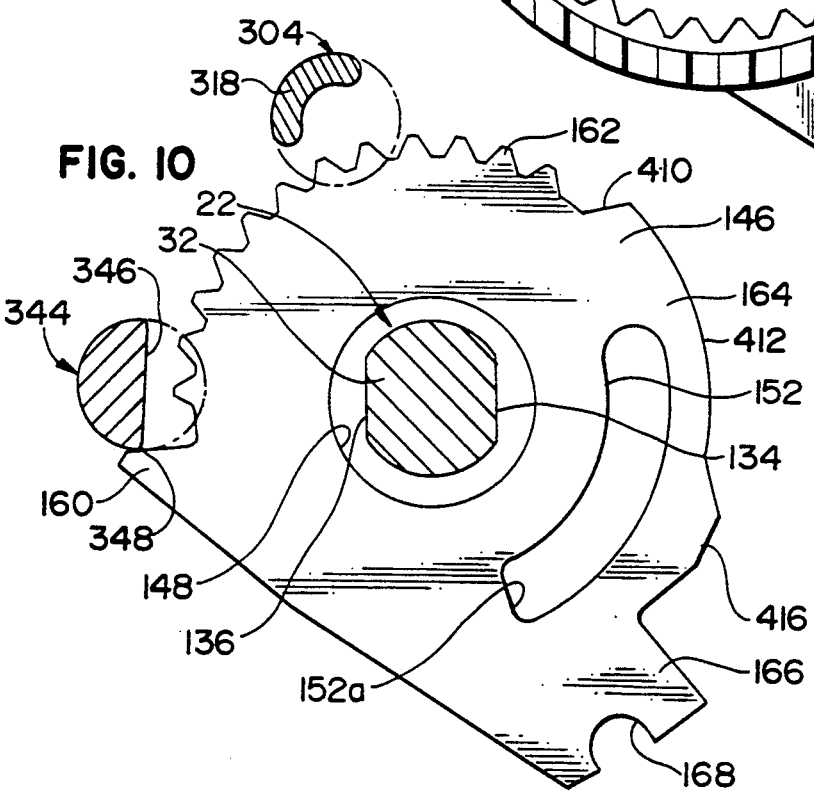
FIG. 10 is an elevational view of the pawls and an associated component. The pawls are shown in cross-section along respective planes normal to their axes.
Figure 16:
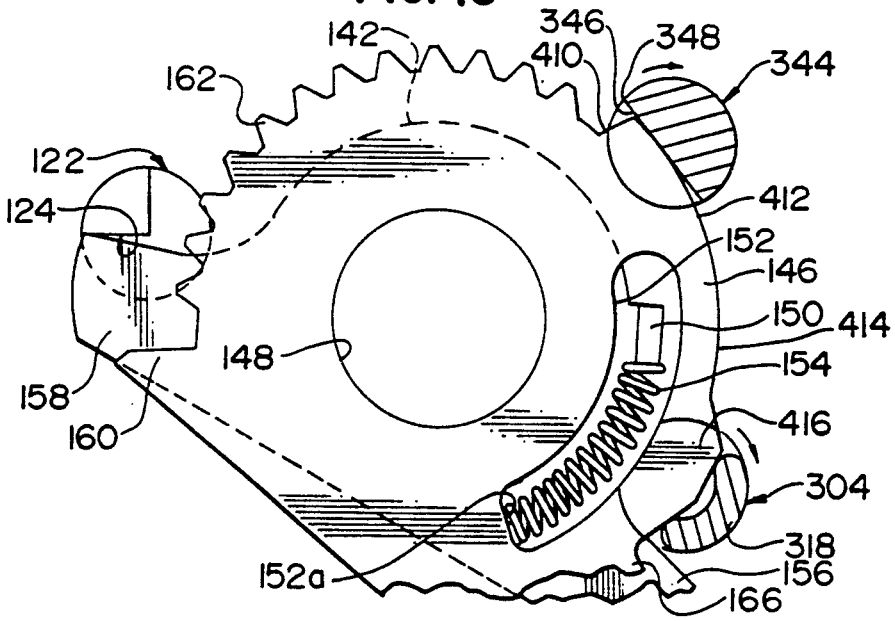
FIG. 16 is a view similar to FIG. 12 but taken to show the pawls and certain associated components in changed positions, as compared to their positions in FIG. 15.

The mounting member 26 is pivotable about the axis defined by the shaft 22 in either rotational direction, as described above, between two extreme positions except when pivotal movement of the mounting member 26 in the tensioning direction is prevented by the stop pawl 344 coacting with the stop plate 146. The extreme position of the mounting member 26 in the tensioning direction is suggested in FIG. 10, in which the stop pawl 344 is shown as having engaged the limiting arm 160 of the stop plate 146 so as to prevent further movement of the mounting member 26 in the tensioning direction. The extreme position of the mounting member 26 in the opposite direction is suggested in FIG. 16, in which the arcuate flange 318 of the ratchet pawl 304 is shown as having engaged the input arm 156 of the actuator plate 142, and in which the output arm 158 of the actuator plate 142 is shown as having engaged the chordal surface 124 of the release pawl 122. Thus, any tension in a strap being handled by the tensioning mechanism 10 can be thus released, if there is some reason to terminate a strapping operation.

As the mounting member 26 is pivoted toward the extreme position in the opposite direction, which is clockwise in the drawings, the mounting member 26 reaches a retarding position, in which further movement of the mounting member 26 toward such extreme position is retarded by the coiled spring 154, which bears on one end 152*a* of the elongate slot 152 of the stop plate 146 and on the axial tab 150 of the actuator plate 142. Additional force tending to compress the coiled spring 154 is required for further movement of the mounting member 26 toward such extreme position.

From the foregoing description, it is evident that, so long as the pin 380 prevents the stop pawl 344 from rotating from its inoperative position into its operative position, the handle 12 can be further pivoted in the tensioning direction, which is counterclockwise in the drawings. Moreover, it is evident that, once the gripping member 28 and the reaction member 30 have overcome the bias imparted by the coiled spring 230 and have pivoted (on the pin 106) relative to the bracket member 32 and the mounting member 26 so to remove the working end 384 of the pin 380 from the pocket 356 of the stop pawl 344, the stop pawl 384 is permitted to rotate and rotates (as it is biased to rotate) from its inoperative position into its operative position. In its operative position, the stop pawl 384 coacts with the teeth 162 of the stop plate 146 so as not to permit the handle 12 to be further pivoted in the tensioning direction, even in small increments.

As described above, the tension limit is controlled by the coiled spring 230 and is settable via the adjusting screw 200, within user-adjustable limits. From the foregoing description, it is evident that more compression of the coiled spring 230 entails that the coiled spring 230 imparts more resistance to pivotal movement of the gripping member 28 and the reaction member 30 (on the pin 106) relative to the bracket member 32 and the mounting member 26, and vice-versa. Moreover, it is evident that more compression of the coiled spring enables more tension to be thus imparted to the strap S before the stop pawl 384 rotates into its operative position so as not to permit the handle 12 to be further pivoted in the tensioning direction, and vice-versa.

Various modifications may be made in the preferred embodiment described above without departing from the scope and spirit of this invention.

I claim:

1. A tensioning mechanism for a strapping tool, the tensioning mechanism comprising a housing structure, a shaft mounted rotatably to the housing structure, a handle coupled to the shaft, and means for coupling the handle to the shaft so as to cause the shaft to be rotatably driven in a tensioning direction when the handle is pivoted about the shaft in one pivotal direction, the coupling means enabling the handle to be oppositely pivoted about the shaft without rotating the shaft, the handle being articulate and including a mounting member, a gripping member, and a reaction member, the mounting member being coupled to the shaft by the coupling means, the gripping member being mounted to the mounting member so as to permit pivotal movement of the gripping member relative to the mounting member between a normal position and a displaced position, the reaction member being movable conjointly with the gripping member between the normal and displaced positions, the handle including means coacting with the mounting and reaction members for biasing the gripping and reaction members toward the normal position, the biasing means permitting the gripping and reaction members to be forcibly displaced toward the displaced position, the tensioning mechanism comprising means coacting with the shaft for controlling pivotal movement of the mounting member about the shaft, the controlling means permitting pivotal movement of the mounting member about the shaft in the tensioning direction with the gripping and reaction members in the normal position and preventing further movement of the mounting member about the shaft in the tensioning direction upon displacement of the gripping and reaction members from the normal position into the displaced position, the biasing means comprising (a) an adjusting screw having a head and a shank and defining an axis, the adjusting screw being mounted to the mounting member so as to permit rotational adjustment of the adjusting screw relative to the mounting member without axial movement of the adjusting screw relative to the mounting member, (b) a follower coacting with the adjusting screw shank and with the mounting member so as to permit axial movement of the follower along the adjusting screw shank without rotational movement of the follower relative to the mounting member upon rotational adjustment of the adjusting screw relative to the mounting member, (c) a spring coacting with the reaction member and with the follower for biasing the gripping and reaction members toward the normal position, the spring being compressible and being arranged so as to be more compressed upon rotational adjustment of the adjusting screw in a first rotational direction and so as to be less compressed upon rotational adjustment of the adjusting screw in a second rotational direction opposite to the first rotational direction, and (d) means for limiting rotational adjustment of the adjusting screw in either of the first and second rotational directions to a limited range, the limiting means being adjustable to adjust the limited range.

2. The tensioning mechanism of claim 1 wherein the adjusting screw shank is tubular and has an external thread and an internal thread, wherein the follower has an aperture with an internal thread coacting with the external thread of the adjusting screw shank, and wherein the limiting means comprises a limiting screw having a head and a shank with an external thread coacting with the internal thread of the adjusting screw shank, the limiting screw head being arranged to engage the reaction member so as to limit rotational adjustment of the adjusting screw in the first rotational direction.

3. The tensioning mechanism of claim 2 wherein the limiting means comprises a washer disposed around the limiting screw shank, between the limiting screw head and the adjusting screw shank.

4. The tensioning mechanism of claim 3 wherein the washer has an annular portion disposed around the limiting screw shank, between the limiting screw head and the adjusting screw shank, and a sleeve portion disposed around the adjusting screw shank.

5. The tensioning mechanism of claim 4 wherein the spring is a coiled spring disposed around the adjusting screw shank, the washer sleeve member, and the limiting screw head.

6. The tensioning mechanism of claim 5 wherein the follower has a tubular member, around which the coiled spring is disposed.

7. The tensioning mechanism of claim 2 wherein the internal thread extends through the head of the adjusting screw, as well as through the shank of the adjusting screw, and wherein the limiting feature comprises a set screw coacting with the internal thread and bearing against the shank of the limiting screw so as to stabilize the limiting screw relative to the adjusting screw.

8. A tensioning mechanism for a strapping tool, the tensioning mechanism comprising a housing structure, a shaft mounted rotatably to the housing structure, a handle coupled to the shaft, and means for coupling the handle to the shaft so as to cause the shaft to be rotatably driven in a given rotatable direction when the handle is pivoted about the shaft in a given pivotal direction, the coupling means enabling the handle to be oppositely pivoted about the shaft without rotating the shaft, the handle being articulate and including a mounting member, a gripping member, and a reaction member, the mounting member being coupled to the shaft by the coupling means, the gripping member being mounted to the mounting member so as to permit pivotal movement of the gripping member relative to the mounting member between a normal position and a displaced position, the reaction member being movable conjointly with the gripping member between the normal and displaced positions, the handle including means coacting with the mounting and reaction members for biasing the gripping and reaction members toward the normal position, the biasing means permitting the gripping and reaction members to be forcibly displaced toward the displaced position, the tensioning mechanism comprising means coacting with the shaft for controlling pivotal movement of the mounting member about the shaft, the controlling means permitting pivotal movement of the mounting member about the shaft in the given rotational direction with the gripping and reaction members in the normal position and preventing further movement of the mounting member about the shaft in the given rotational direction upon displacement of the gripping and reaction members from the normal position into the displaced position, the controlling means comprising (a) a stop plate having an arcuate array of stop teeth in coaxial relation to the shaft and in fixed relation to the housing structure, (b) a stop pawl mounted to the mounting member so as to be rotatably movable between an operative position and an inoperative position, the stop pawl permitting pivotal movement of the mounting member in the tensioning direction in the inoperative position, the stop pawl coacting with the stop plate in the operative position so as to prevent pivotal movement of the mounting member in the tensioning direction, the stop pawl having an engagement portion disposed to be fully disengaged from all of the stop teeth in the inoperative position and to engage at least one of the stop teeth in the operative position, (c) means for biasing the stop pawl rotationally toward the operative position, and (d) means for retaining the stop pawl releasably in the inoperative position with the gripping and reaction members in the normal position, the retaining means releasing the stop pawl so as to permit the stop pawl to rotate toward the operative position upon displacement of the gripping and reaction members from the normal position into the displaced position.

9. The tensioning mechanism of claim 8 wherein the stop pawl has a pocket and wherein the retaining means comprises a pin carried by the reaction member, the pin being arranged to be removably inserted into the pocket so as to retain the stop pawl in the inoperative position when the stop pawl is rotated into the inoperative position with the gripping and reaction members in the normal position, the pin being removable from the pocket so as to release the stop pawl when the gripping and reaction members are displaced from the normal position into the displaced position.

10. The tensioning mechanism of claim 9 wherein the mounting member is pivotable between an extreme position in the tensioning direction and an extreme position in an opposite direction, except when pivotal movement of the mounting member in the given rotational direction is prevented by the stop pawl, and wherein the tensioning mechanism comprises means for rotating the stop pawl from the operative position into the inoperative position upon pivotal movement of the mounting member to a rotating position corresponding to the extreme position in the opposite direction, the rotating means coacting with the stop pawl so as to retard pivotal movement of the mounting member toward the rotating position when the mounting member reaches a retarding position before the rotating position but permitting the mounting member to be forcibly pivoted beyond the retarding position to the rotating position.

* * * * *